US009096070B2

(12) United States Patent
Studer et al.

(10) Patent No.: US 9,096,070 B2
(45) Date of Patent: Aug. 4, 2015

(54) COLORANT TRANSFER SYSTEMS

(75) Inventors: Anthony D. Studer, Albany, OR (US); Alan Shibata, Camas, WA (US); Bruce Alan McFadden, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/368,544

(22) PCT Filed: Feb. 29, 2012

(86) PCT No.: PCT/US2012/027133

§ 371 (c)(1), (2), (4) Date: Jun. 25, 2014

(87) PCT Pub. No.: WO2013/130073

PCT Pub. Date: Sep. 6, 2013

(65) Prior Publication Data

US 2015/0029242 A1 Jan. 29, 2015

(51) Int. Cl.

| | |
|---|---|
| ***B41J 2/165*** | (2006.01) |
| ***B41J 2/21*** | (2006.01) |
| ***B41J 2/175*** | (2006.01) |
| ***G03G 15/08*** | (2006.01) |
| *G03G 15/00* | (2006.01) |

(52) U.S. Cl.

CPC .. *B41J 2/21* (2013.01); *B41J 2/175* (2013.01); *G03G 15/0863* (2013.01); *G03G 15/0877* (2013.01); *G03G 15/5091* (2013.01)

(58) Field of Classification Search

None

See application file for complete search history.

(56) References Cited

U.S. PATENT DOCUMENTS

| | | | | |
|---|---|---|---|---|
| 5,686,947 | A | 11/1997 | Murray et al. | |
| 5,749,859 | A * | 5/1998 | Powell | 604/167.03 |
| 6,158,850 | A * | 12/2000 | Cook | 347/85 |
| 6,161,913 | A | 12/2000 | Childers et al. | |
| 6,164,766 | A | 12/2000 | Erickson | |
| 7,758,174 | B2 | 7/2010 | Karppinen et al. | |
| 7,950,788 | B2 | 5/2011 | Therien et al. | |
| 8,002,384 | B2 | 8/2011 | Hibbard et al. | |
| 8,414,115 | B2 | 4/2013 | Shibata | |
| 2004/0165039 | A1 | 8/2004 | Dietl | |
| 2007/0171250 | A1 | 7/2007 | Tanaka et al. | |
| 2007/0279465 | A1 | 12/2007 | Shindo | |
| 2008/0259112 | A1 | 10/2008 | Olsen et al. | |
| 2013/0010029 | A1 * | 1/2013 | Kuo | 347/37 |

FOREIGN PATENT DOCUMENTS

| | | |
|---|---|---|
| CN | 02126350 | 7/2011 |
| CN | 102343721 | 2/2012 |
| JP | 2005297447 | 10/2005 |

* cited by examiner

*Primary Examiner* — Alejandro Valencia

(74) *Attorney, Agent, or Firm* — Hewlett-Packard Patent Department

(57) ABSTRACT

Colorant transfer, involving a colorant supply, and impeding colorant from exiting the colorant supply, a motion device, and providing a passage out of the colorant supply.

12 Claims, 9 Drawing Sheets

COLORANT TRANSFER SYSTEMS

BACKGROUND

Colorant transfer systems such as printers are provided with colorant supplies for supplying the colorant to a colorant delivery device. A colorant delivery device is a device that delivers colorant to media, such as for example inkjet printheads or toner transfer rollers. Examples of colorant supplies are toner cartridges, ink cartridges and/or intermediate regulators such as pressure regulators.

Most printers work with exchangeable colorant supplies such as exchangeable cartridges. The printer is usually purchased in a condition wherein the colorant delivery device is free of colorant. A separate colorant cartridge needs to be installed in the printer before initiation. Some printers are configured to recognize a cartridge installation and automatically start a prime or service print process after having recognized the installation. If a colorant cartridge reaches its empty state, a new colorant cartridge needs to be bought and re-installed.

BRIEF DESCRIPTION OF THE DRAWINGS

For the purpose of illustration, certain examples constructed in accordance with the teachings of this disclosure will now be described with reference to the accompanying drawings, in which.

DETAILED DESCRIPTION

In the following detailed description, reference is made to the accompanying drawings. The examples in the description and drawings should be considered illustrative and are not to be considered as limiting to the specific example or element described. Multiple examples may be derived from the following description and/or drawings through modification, combination or variation of certain elements. Furthermore, it may be understood that examples or elements that are not literally described may be derived from the description and drawings by a person of ordinary skill in the art.

Figure 1:
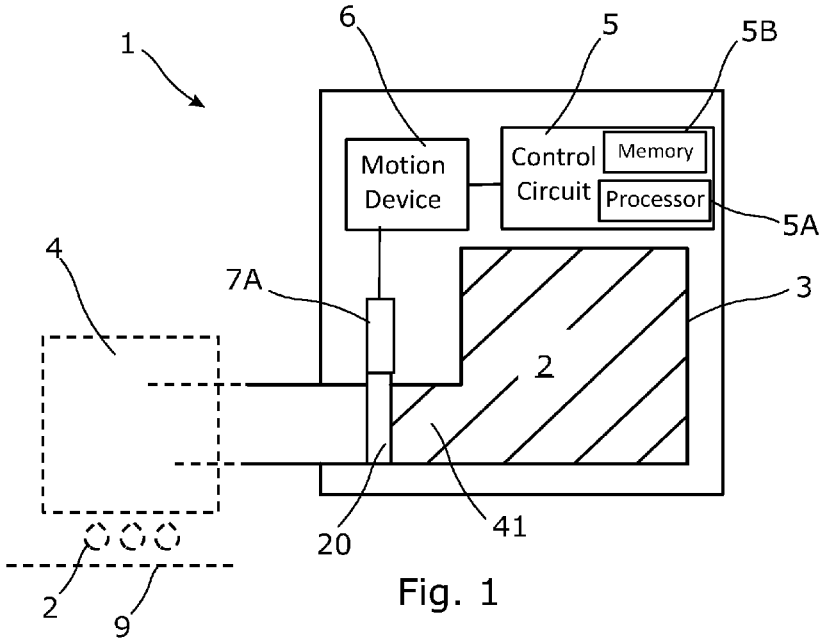
FIG. 1 illustrates a diagram of an example of a colorant transfer system in a first state.

FIG. 1 shows an example of a colorant transfer system 1. The colorant transfer system 1 includes a colorant supply 3 for supplying colorant 2 contained in the supply 3 to a further colorant delivery device 4. The colorant delivery device 4 is arranged to deliver the colorant 2 to a media 9. The colorant transfer system 1 may include or be a part of a printer, such as an electrophotographic printer or an inkjet printer. The colorant 2 for example includes dry or liquid toner or ink. Some examples of the colorant delivery device 4 include a printhead for ejecting ink on the media 9. Other examples of the colorant delivery device 4 include a toner transfer roller and/or photoconductor for transferring toner to the media 9.

In the illustrated example, the colorant transfer system 1 includes a motion device 6. The motion device 6 is arranged to move the actuator 7A. The actuator 7A is arranged to provide a passage 40 (FIG. 2) from the colorant supply 3 to the colorant delivery device 4. Herein, "providing" a passage 40 may be understood as opening or establishing a passage 40, for example by connecting interconnect portions or removing an obstacle such as a seal 20 to allowing the colorant 2 to pass to the colorant delivery device 4.

The example colorant transfer system 1 includes a control circuit 5. The control circuit 5 may be an integrated circuit. The control circuit 5 may include a processor SA and a memory device SB. In some examples, the control circuit 5 includes a digital or analogue application specific integrated circuit. In some examples, he control circuit 5 includes a formatter. In some examples, the control circuit 5 includes one or more integrated circuits and one or more interfaces. The motion device 6 is connected to the control circuit 5. The control circuit 5 is configured to instruct the motion device 6, in a first example as actuator triggering device, and in a second example as both actuator triggering device and general motion device for driving other components of the colorant transfer system 1.

In the example shown in FIG. 1, the colorant supply 3 is a first state wherein the colorant 2 is impeded from exiting the colorant supply 3. In the illustrated example first state, the actuator 7A is in a position wherein an outlet of the supply 3 is blocked, for example sealed or closed off by a valve or the like.

In an example, the actuator 7A is arranged to establish the passage 40, for example by opening a seal 20 or valve or the like that blocks that outlet 41. In the illustrated example first state the actuator 7A of FIG. 1 has not actuated yet and the passage 40 has not yet been established.

Since the colorant is impeded from exiting the supply 3 in the first state, not using the colorant transfer system 1 for a relatively long time in the first state will not be harmful for the colorant transfer system 1. For example, the first state may be a suitable condition of the colorant transfer system 1 before usage, for example during storage in warehouses or stores, or during transportation or the like. Impeding exit of colorant 2 may be understood as preventing the colorant 2 from leaking, expiring, drying out and/or the like while contained in the supply 3 in the first state. Of course, in practice there is a time limit as to how long one can store colorant 2 in a substantially dosed off supply 3, in the sense that it may be unavoidable that certain colorant amounts may escape, clog, be affected or dry out in time, as with conventional colorant cartridges as certain materials may age or be affected in time.

In some examples, the seal 20 may be arranged for inhibiting leakage of colorant 2 out of, or fluid out of or into, the colorant supply 3, and to be opened to provide for the passage 40. For example, the seal 20 or the like prevents gas or liquid from entering or escaping from the supply 3. The seal 20 may comprise a septum, a film, a cover, glue, tap, or any other suitable means for mechanical connection or opening for first storing and later releasing the colorant.

Figure 2:
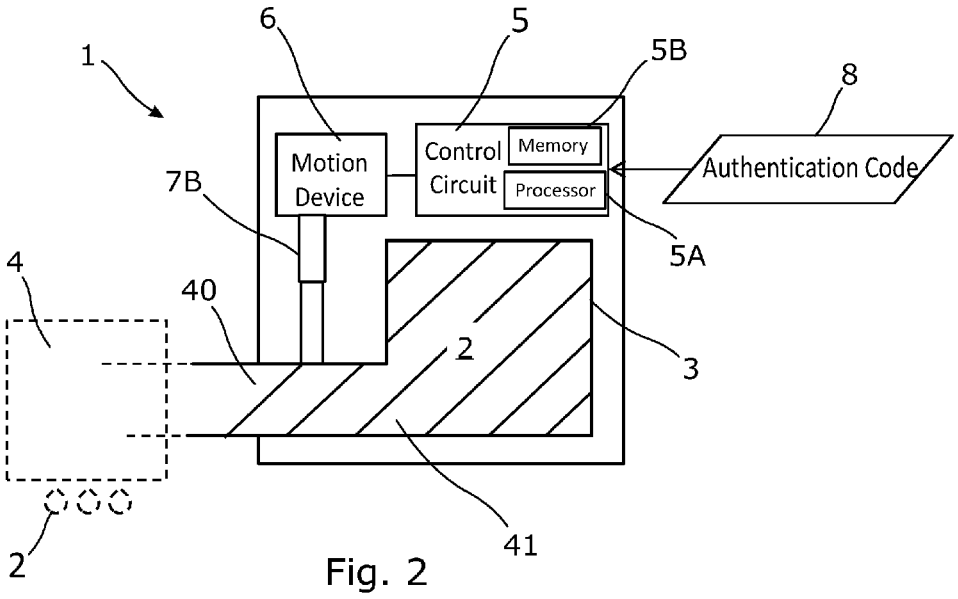
FIG. 2 illustrates a diagram of an example of a colorant transfer system in a second state.

FIG. 2 shows the colorant transfer system 1 of FIG. 1 in a second state different than the first state, wherein a colorant passage 40 is established between the colorant supply 3 and the colorant delivery device 4. In the illustrated example, the motion device 6 has triggered the actuator 7B to provide the passage 20. As illustrated, the actuator 7B has at least partly moved into a second position with respect to the first position as illustrated in FIG. 1, establishing the passage 40 by said movement. For example, the passage 40 may be provided through an opening, removing, moving, breaking or the like of the seal 20, valve or other closure, or by establishing a fluidic connection, though the action of the actuator 7B.

The example of FIG. 2 also includes an authentication code 8. The authentication code 8 may include data that is needed to authorize supply of the colorant 2. In other examples, different authentication codes 8 may be suitable. In some examples, the authentication code 8 is a coded signal. For example the authentication code 8 may include any verification or authorization signal that is needed to release the system 1. In some examples, the authentication code is different from a coded signal that is sent for establishing the colorant passage 40 only, but for example not for switching on the color transfer system 1 or for signaling subsequent print actions. In some examples, the authentication code 8 is configured so that a special authorization (e.g. after payment) or special dedicated knowledge is needed to trigger the system 1. In some such examples, the authentication code 8 is a numerical code or an asymmetrically or symmetrically encrypted code. The authentication code 8 may be entered manually or through any type of data connection. The control circuit 5 is configured to process the authentication code 8. The control circuit 5 is configured to validate (i.e. authenticate) the authentication code 8. In some examples, the validation includes a processing of the authentication code 8, a comparison of the authentication code 8, or the processed variant thereof, with another code, or a processed variant thereof, and a confirmation if there is a positive result of the comparison. In some examples, validation includes a decryption process such as asymmetric or symmetric decryption. Positive validation may justify a passage 40 of the colorant 2 in the colorant supply 3 to the colorant delivery device 4. The control circuit 5 is configured to, upon validation of the authentication code 8, instruct the motion device 6 to trigger the actuator 7A to provide a passage 20 from the colorant supply 3 to the colorant delivery device 4. In some examples, validating the authentication code 8 enables authorized users to activate the colorant transfer system 1 while excluding unauthorized users from the same.

Figure 3:
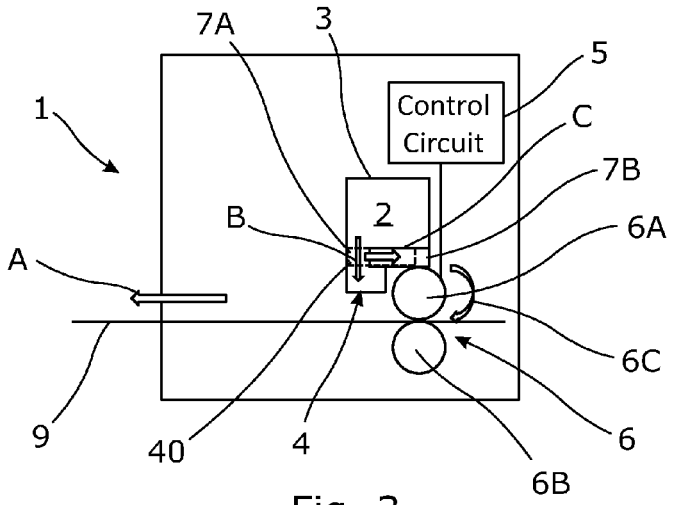
FIG. 3 illustrates a diagram of another example of a colorant transfer system in a first and second state.

FIG. 3 illustrates another example of a colorant transfer system 1. The colorant transfer system 1 includes a motion device 6. In the example of FIG. 3, the motion device 6 includes a first motion device portion 6A and a second motion device portion 6B. In some examples, the first motion device portion 6A is arranged to execute a movement 6C, for example a rotation or translation. In some examples, the motion device 6 is part of a media advance system, for advancing the media 9 in a direction A. In other examples, the motion device 6 is part of a toner transfer system, for example including photoconductor rollers, or toner transfer rollers. In some examples, the motion device 6 includes a motor such as an electromotor or the like. In other examples, the motion device 6 includes a printhead scanning system.

A supply 3 is provided including colorant 2. The actuator 7A, 7B is shown in both a first and second state, respectively, wherein the first state represents a closed off condition of the colorant 2 in the supply 3 and in the second state the system 1 includes an established colorant passage 40 from the supply 3 to the colorant delivery device 4. FIG. 3 shows an example of a direction of colorant flow B from the supply 3 to the colorant device 4. FIG. 3 also shows a direction of an actuator movement C of the actuator 7A, 7B from the first to the second state, respectively. In an example the actuator movement C establishes the passage 40.

FIG. 3 illustrates an example wherein the actuator 7A is arranged so that the motion device 6 triggers the actuator 7A. For example, through the movement 6C of the motion device 6 the actuator 7A is moved from the first to the second state to provide for the colorant passage 40. In some examples, a mechanical transmission or activation mechanism is provided between the actuator 7A and the motion device 6 for triggering the actuator 7A.

In an example colorant transfer system 1, only a first movement 6C of the motion device 6 mechanically triggers the actuator 7A. Such a first movement 6C may for example be a scanning movement, a media advance rotation or translation movement, or an electromotor rotation, or another movement. Once the actuator 7B has reached the second state through said triggering, other similar movements of the same motion device 6 do not trigger the actuator 7B anymore. This allows the colorant passage 40 to be established when the colorant transfer system 1 is activated for the first time. Example effects may be that the quantity and quality of the colorant 2 is maintained until the passage 40 is established and no manual install of the supply 3 or opening of the supply 3 has to be executed.

In an example, it is enough to activate the colorant transfer system 1 for establishing the passage 40. In an example, the colorant transfer system 1 is arranged so that a standard motion device movement 6C, which would need to be executed anyway for performing a print action, triggers the actuator 7A to provide the passage 40. For example, such standard movements 6C could be one of a printhead scanning movement, a media advance movement, a roller rotational movement, a colorant delivery device movement or another standard motion device movement 6C. In some examples, a transmission or trigger mechanism is provided between the motion device 6 and the actuator 7A. These features may allow that no separate motion device 6 is needed to provide for the colorant passage 40.

Figure 4:
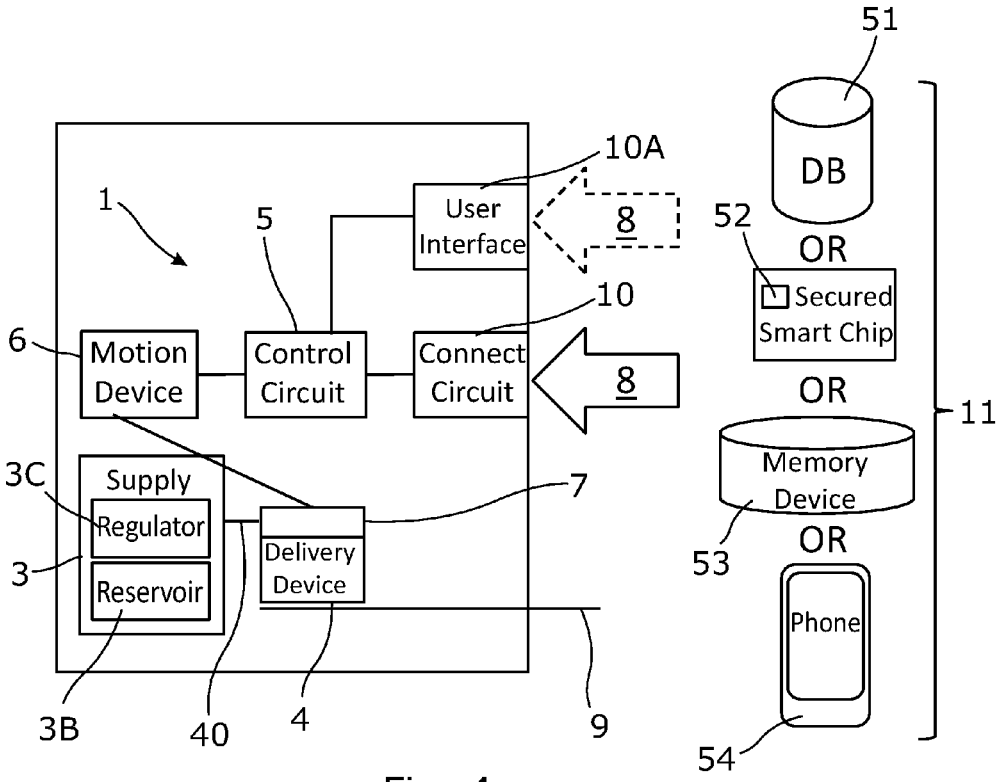
FIG. 4 illustrates a diagram again another example of a colorant transfer system.

As illustrated in FIG. 4, in an example the control circuit 5 includes or is connected to a data source connection circuit 10 for receiving the authentication code 8. The data source connection circuit 10 is configured to receive the authentication code 8 from a source 11 external to the colorant transfer system 1.

In some examples, the source 11 includes a database or server external to the colorant transfer system 1. The database or server 51 may be connected to the connection circuit 10 through a physical and/or wireless interface and/or network, for example through the internet. In some such examples, the connection circuit 10 includes an intermediate or direct internet connection interface, a wireless interface, such as a radio interface, Bluetooth, wireless fidelity interface, or a wireless telecommunication interface or any wired or physical network interface. In some examples the server 51 is arranged to provide the authentication code 8 to the connection circuit 10 after receiving a request from a third party such a sales channel, or after confirming a payment or billing corresponding to a portion or the full amount of the colorant 2.

In other examples, the source 11 includes a smart chip or a secure integrated circuit 52, for example on a card. In some such examples, the data source connection circuit 10 includes a slot or the like, and/or an electrode array for connection of the secure integrated circuit 52 to the control circuit 5.

In further examples, the source 11 includes a second memory device 53. In some examples, the second memory device 53 stores the authentication code 8 and is configured to provide the authentication code 8 to the control circuit 5 when connected to the connection circuit 10. The second memory device 53 may be portable and may include a flash memory, a memory card, a non-volatile memory, an usb-device and/or any other type of memory device 53 that can be connected to the connection circuit 53.

In other examples, the source 11 includes a device 54 capable of telecommunication such as for example a phone or tablet. In some such examples, the telecommunication device 54 is arranged to receive and/or store the authentication code 8, and provide the authentication code 8 to the colorant transfer system 1 through the connection circuit 10, through any suitable wireless interface including wireless internet, telecommunication, Bluetooth, radio frequencies, etc.

In other examples, the authentication code 8 is provided to the control circuit 5 through manual input of the authentication code 8 through a user interface 10A, such as for example a touch screen or key pad. In again further examples, any combination of the examples of sources 11, named or not named above, and the manual input as described herein may be used to provide the authentication code 8 to the control circuit 5.

In some examples (not shown), the control circuit 5 is configured to decode the authentication code 8 and compare the decoded code to an internally or externally stored code. In other examples, the control circuit 5 is configured to decrypt the authentication code 8.

The colorant supply 3 includes a colorant reservoir 3B stored internal to the colorant transfer system 1. In some examples, the colorant reservoir 3B is arranged to be non-removable from an end-user point of view. In some examples, the colorant reservoir 3B contains approximately 10 milliliters or more, or approximately 50 milliliters or more, or approximately 100 milliliters or more of colorant such as ink or similar amounts or more in milligrams of dry toner. In some examples, these volumes are the summed volumes of multiple reservoirs present in the colorant transfer system 1. In other examples, said volumes are of one reservoir only. For example, the quantity of colorant 2 may be based on a printing of at least approximately 5000 pages, or at least approximately 10000 pages, or at least approximately 15000 pages or at least approximately 20000 pages, the pages being for example of A4 or letter size, according to common printing standards. The colorant quantity in the reservoir 3B may correspond to a quantity for supplying the colorant transfer system 1 with colorant during the estimated lifetime of the colorant transfer system 1.

In the illustrated example, the supply 3 includes a regulator 3C, for example a pressure regulator or flow regulator, for example for regulating the supply of colorant 2 to the colorant delivery device 4, the colorant being ink or toner. For example, the regulator 3C may be arranged between the reservoir 3B and the colorant delivery device 4. Note that in some examples, the supply 3 is a colorant regulator 3C only or a colorant reservoir 3B only.

The example colorant transfer system 1 of FIG. 4 further includes the motion device 6 connected to the control circuit 5, and the actuator 7 for providing the passage 40 from the colorant supply 3 to the colorant delivery device 4. The control circuit 5 is configured to validate the authentication code 8 as received through the connection circuit 10 or user interface 10A. The control circuit 5 is configured to, once the authentication code 8 is validated, release the colorant 2 from the supply 3 by instructing the motion device 6 to trigger the actuator 7 to provide the passage 40 from the colorant supply 3 to the colorant delivery device 4.

Figure 5:
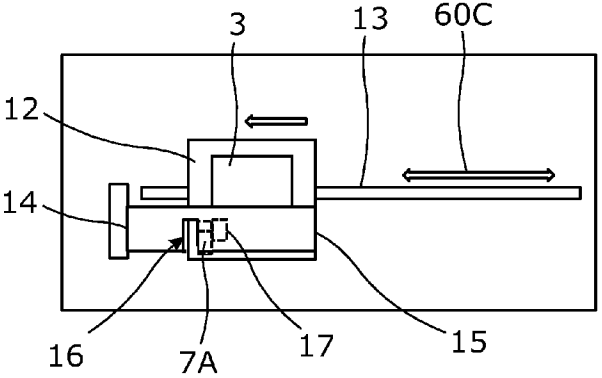
FIG. 5 illustrates a diagram of yet another example of a colorant transfer system in a first state, in a cross sectional front view.
Figure 7:
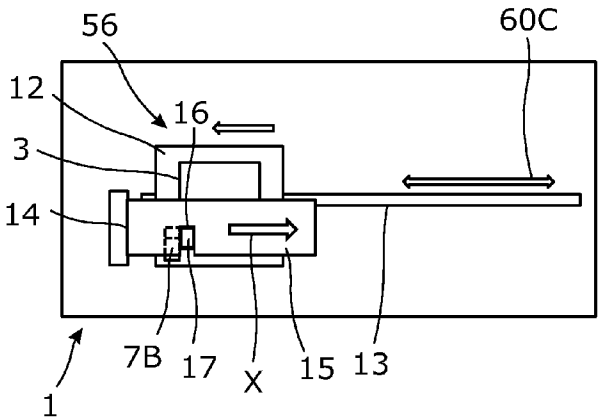
FIG. 7 illustrates a diagram of the example of FIGS. 5 and 6 in a second state, in a cross sectional front view.
Figure 6:
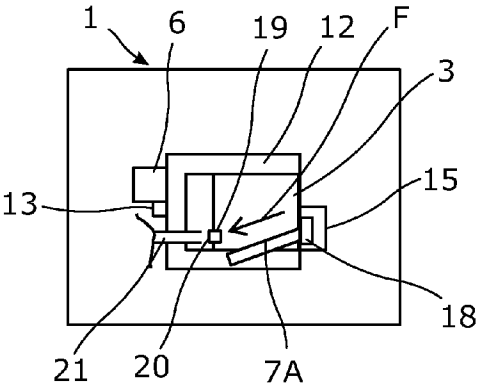
FIG. 6 illustrates a diagram of the example and state of FIG. 5, in a cross sectional side view.
Figure 8:
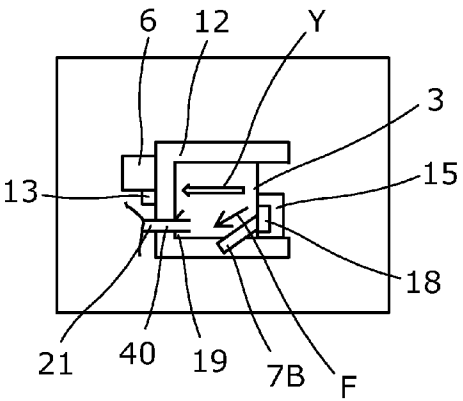
FIG. 8 illustrates a diagram of the example and state of FIG. 7, in a cross sectional side view.

FIGS. 5 and 6 show a cross sectional front view and side view, respectively, of an example of a colorant transfer system 1 in the first state wherein the colorant 2 is impeded from exiting the colorant supply 3. FIGS. 7 and 8 show a cross sectional front view and side view, respectively, of the same example transfer system 1 in the second state wherein the passage 40 between the colorant supply 3 and the colorant delivery device 4 is provided. The colorant transfer system 1 includes a carriage 12 that is arranged to scan over a print medium. The carriage 12 is arranged to receive a supply 3. For example, the supply 3 includes at least one of a back pressure regulator and a reservoir.

In the illustrated example, the colorant transfer system 1 includes a scan axis 13 for guiding the carriage 12. The colorant transfer system 1 includes a release feature 15. For example, the release feature 15 comprises a bar or the like. For example, the release feature 15 includes a release opening 16. In some examples, the release feature 15 is arranged to have a fixed position with respect to the supply 3 in a direction Y perpendicular to the scanning movement while being moveable with respect to the supply 3 in a direction X parallel to the direction of the scanning movement 60C. For example, a release feature guide 18 is provided. For example, the release feature guide 18 is arranged to allow movement of the release feature 15 with respect to the supply 3 in the direction X parallel to the direction of the scanning movement 60C.

In the illustrated example, a retainer 17 is fixedly connected to the carriage 12. The retainer 17 retains the release feature 15, and therewith the supply 3, in a retained state, at least until the release feature 15 is moved into a release position with respect to the retainer 17. In some examples, the colorant transfer system 1 includes a block 14 arranged to engage the release feature 15. For example, the block 14 is arranged to engage the release feature 15 when the carriage 12 reaches one of its extreme positions 56 after a first scanning movement 60C. For example, when engaging the release feature 15 during or after the first scanning movement 60C the release feature 15 is moved with respect to the supply 3 in the direction X that is parallel to the scanning direction, until the release opening 16 is located opposite to the retainer 17. When the release opening 16 is located opposite to the retainer 17, the release feature 15 has reached a release position with respect to the retainer 17, which releases a force of the actuator 7A.

For example, the actuator 7A, 7B is connected on one of its ends to the supply 3 and on another of its ends to the carriage 12. In some examples, the actuator 7A, 7B is arranged to store mechanical energy. The actuator 7A, 7B is arranged to store mechanical energy for example when compressed or extended. In the illustrated example, the actuator 7A, 7B includes a resilient component such as a helical spring. In some examples, the actuator 7A, 7B includes another spring type such as a torsion spring, leaf spring, helical spring, etc. In other examples, the actuator 7A, 7B includes memory shape material, other resilient components, or any suitable elastomeric material. The actuator 7A, 7B may be arranged to be deformed and restored, pressurized or depressurized, stressed or compressed, and may comprise any component that would allow a storing of force or energy. In some examples, the actuator 7A, 7B comprises stressed or compressed gas, fluid, or solid material. In some examples, the actuator 7A, 7B comprises metal, elastomeric material, plastics, etc. In the illustrated example, the actuator 7A, 7B is arranged to actuate upon the colorant supply 3 for moving the supply 3 into a mated state, allowing colorant to flow to the colorant delivery device 4.

In FIGS. 5 and 6 the actuator 7A is shown in an extended state, wherein it has stored its mechanical force. The retainer 17 holds back the supply 3 against a pulling force F of the actuator 7A, 7B by engaging and therewith retaining the release feature 15. In first state, as shown in FIG. 6, first and second colorant interconnects 19, 21 are disconnected and the supply seal 20 seals off the supply 3. In the illustrated example the first colorant interconnect 19 comprises a colorant outlet of the supply 3, arranged to mate with the second interconnect 21. The second colorant interconnect 21 is arranged to allow colorant flow to the colorant delivery device 4 (not shown in this figure). In the illustrated example, the second colorant interconnect 21 includes a fluidic needle arranged to mate with the first colorant interconnect 19.

In FIGS. 7 and 8 the block 14 has acted upon the release feature 15, moving the release feature 15 in a direction X parallel to the scanning direction until the release feature opening 16 reached a position opposite to the retainer 17. This causes the retainer to disengage and release the release feature 15, and therewith the stored actuator energy. The release opening 16 may slide over the retainer 17. Upon release, the mechanical force F pulls the supply 3 into the carriage 12, for example in a direction Y perpendicular to the scanning direction, so as to mate the colorant interconnects 19, 21 and provide for the passage 40 between the supply 3 and the colorant delivery device 4 (not shown). In the illustrated example, the first colorant interconnect 19 is moved in the direction Y of the second colorant interconnect 21 for mating. In other examples however, the second interconnect 21 is moved in the direction of the first colorant interconnect 19 for establishing the passage 40.

In some examples, in a first state, the supply 3 includes a seal 20 for the first colorant interconnect 19 (FIG. 6). In some examples, the seal 20 is arranged to break. In other examples, the seal 20 includes a cover, valve or septum that does not need to be broken to be opened.

Figure 9:
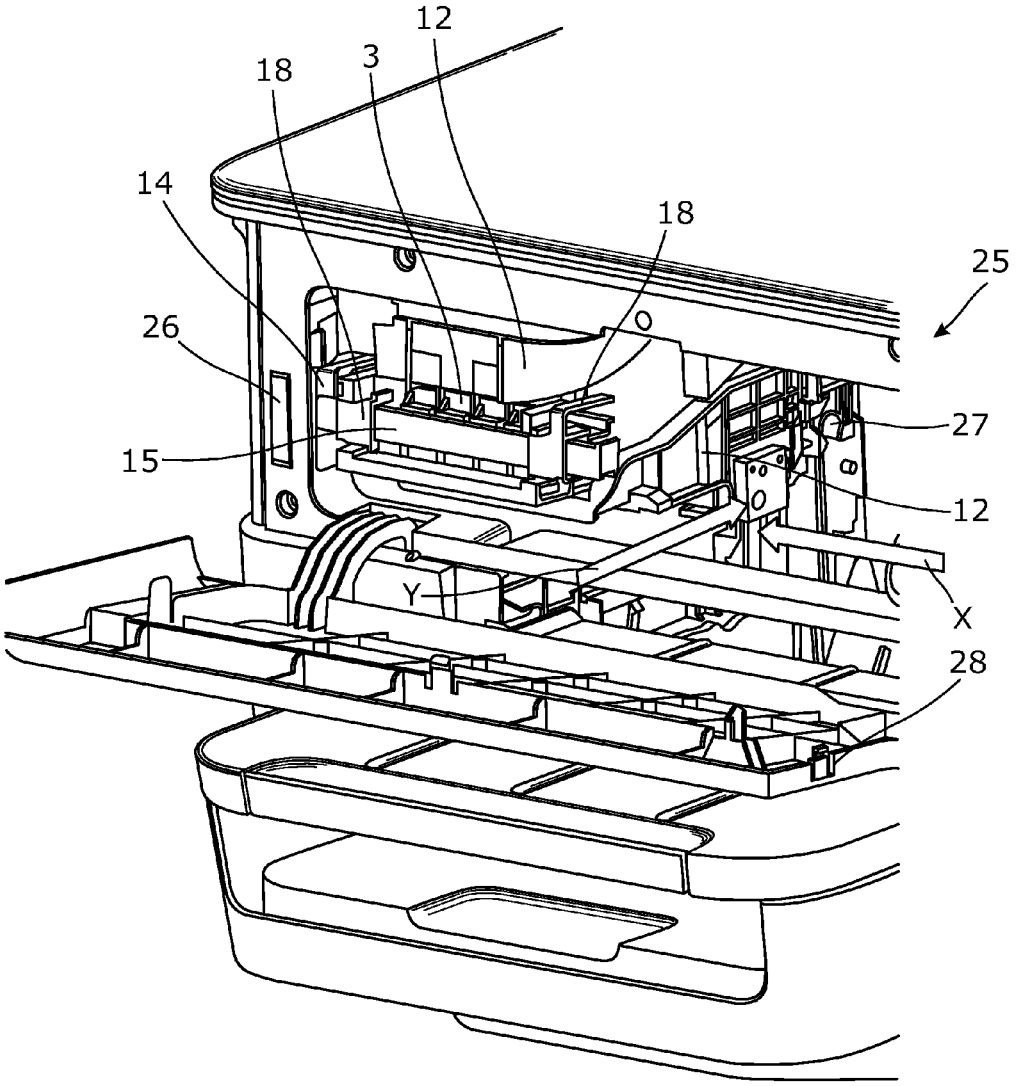
FIG. 9 illustrates a portion of an example of a printer in a perspective view.

FIG. 9 illustrates an example of a printer 25, for example an inkjet printer. For example, the colorant delivery device 4 comprises a scanning carriage 12. FIG. 9 shows the carriage 12 in an extreme position, wherein the release feature 15 engages the block 14. In the illustrated example, the carriage carries multiple supplies 3. The carriage 12 includes an axis guide feature 27 for guiding the carriage 12 over the scanning axis 13 (not shown in FIG. 9). The printer 25 includes a release feature 15 such as, for example, a bar. The printer 25 includes a release feature guide 18 for guiding the release feature 15 in a direction parallel to the scanning direction X, and once released also in a direction Y perpendicular to the scanning direction. Furthermore an access door 28 is illustrated in an opened state. In some examples, the access door is locked for an end user or unauthorized party.

The printer 25 includes a block insert 26 for inserting the block 14. In some examples, the block insert 26 comprises a slot. The block insert 26 allows for the block 14 to be positioned in the printer, or taken out of the printer 25. For example, if the block 14 is not placed in the insert 26, the block 14 does not engage the release feature 15 after a scanning movement of the carriage 12 so that the actuator 7A, 7B is not triggered. For example, as long as the block 14 is not placed a risk of an unintentional triggering of the actuator 7A, 7B can be reduced. In some examples, the block 14 is not located in the insert 26 during transport or warehouse storage of the printer 25. The block 14 can be inserted before a transport.

Figure 10:
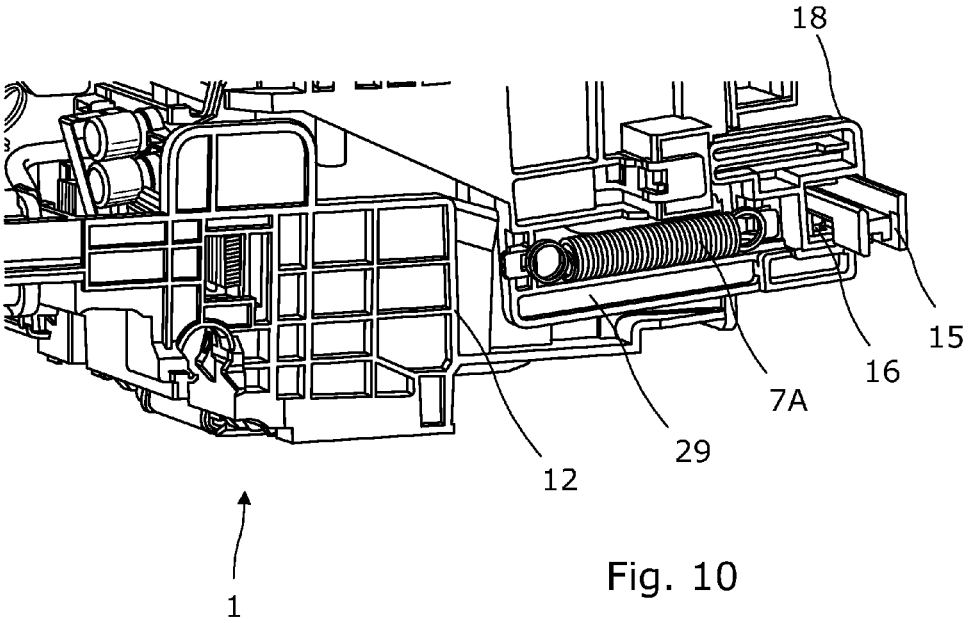
FIG. 10 illustrates an example of a portion of a colorant transfer system in a first state in perspective view.
Figure 11:
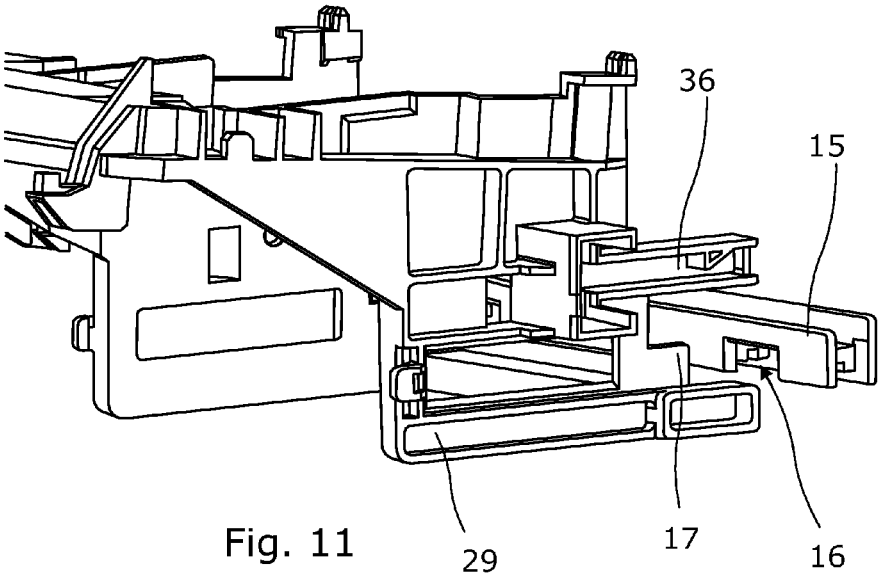
FIG. 11 illustrates an example of a sub-frame of the colorant transfer system portion and state of FIG. 10 in perspective view.
Figure 12:
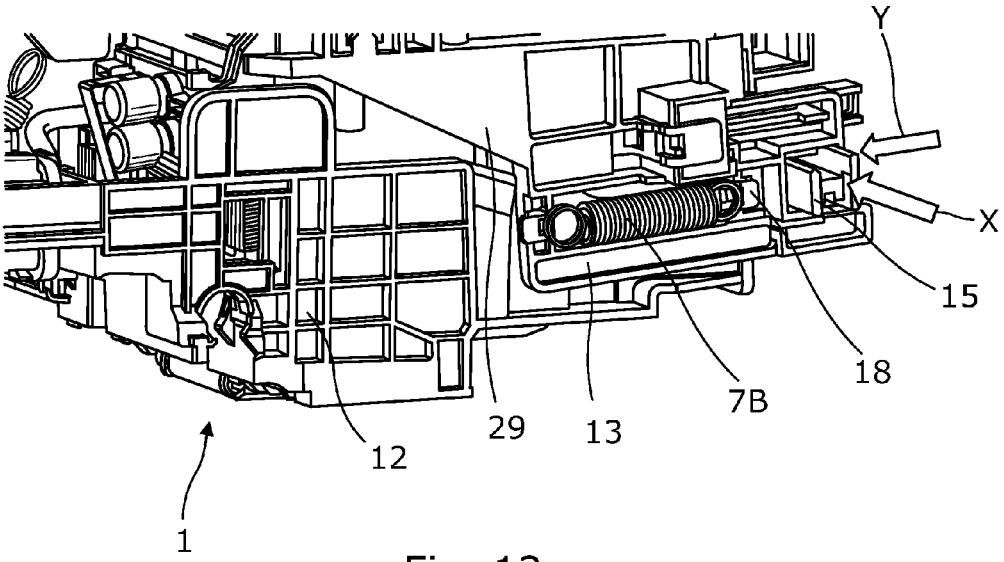
FIG. 12 illustrates an example of a portion of the colorant transfer system of FIG. 10 in a second state in perspective view.
Figure 13:
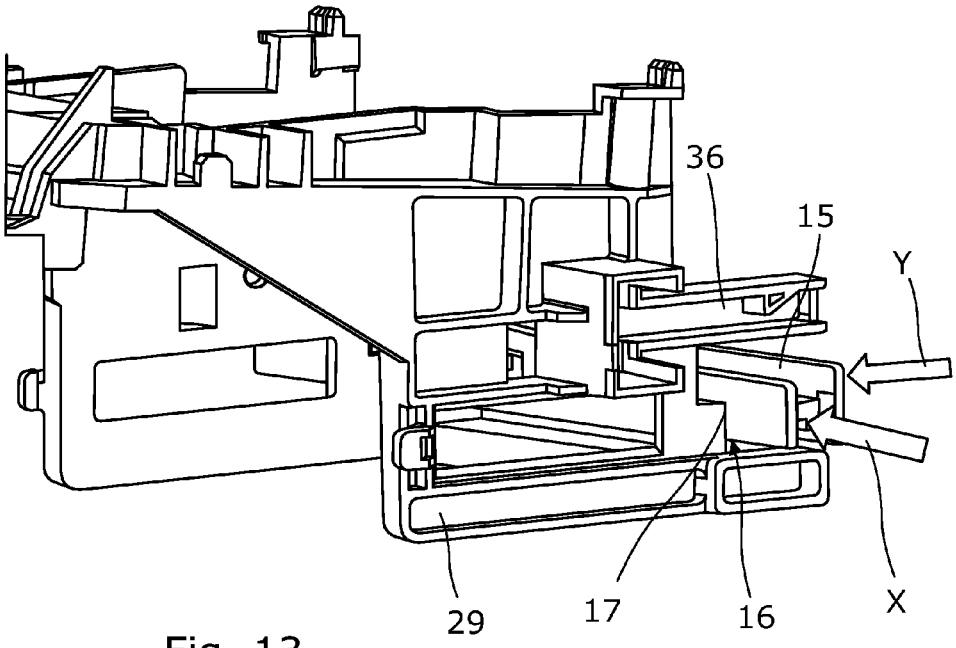
FIG. 13 illustrates an example of a sub-frame of the colorant transfer system portion and state of FIG. 12 in perspective view.

FIGS. 10-13 illustrate examples of portions of the colorant transfer system 1. FIGS. 10 and 11 illustrate a first state of the transfer system 1. FIGS. 12 and 13 illustrate a second state of the transfer system 1. As illustrated in FIGS. 10 and 12, the carriage 12 includes a carriage sub-frame 29 that is mounted to the carriage 12. FIGS. 11 and 13 show the sub-frame 29 and the release feature 15 in the first and second state, respectively. A top portion of the drawings of FIGS. 10 and 12 is cut off.

In the illustrated examples, the carriage sub-frame 29 is fixedly mounted to the carriage 12. In FIG. 10, the actuator 7A is illustrated in the state wherein the mechanical energy is stored. In the illustrated example, the actuator 7A includes a helical spring and the energy is stored by a pulling the spring. In some examples, a second actuator 7A is provided on the opposite site of the shown portion of the color transfer system 1. The release feature 15 is connected to the supplies 3 and is guided by the release feature guide 18. In the illustrated example the release feature guide 18 guides the release feature 15 parallel to a scanning direction X, and upon release in a direction Y approximately perpendicular to the scanning direction. The actuator 7A, 7B is connected, on one end, to the carriage 12, or carriage sub-frame 29 and on the other end to the release feature guide 18 (FIGS. 10, 12).

In the first state (FIGS. 10, 11) the actuator 7A is retained in the stressed condition by the retainer 17 (FIG. 11) that engages the release feature 15. In the illustrated example first state the actuator 7A, 7B pulls the release feature guide 18 which in turn pulls the release feature 15 in said direction Y perpendicular to the scanning direction X. In the second state (FIGS. 12, 13), the release feature opening 16 is positioned opposite the retainer 17 so that the release feature 15 is disengaged from the retainer 17. For example, the retainer 17 is a fixed or integral part of the carriage sub-frame 29. In the release position, the release feature 15 and the release feature guide 18 are permitted to slide in the direction Y of the carriage 12. For example, in the release position the release feature guide 18 slides over a corresponding guide part 36 of the carriage sub-frame 29. In the release position, the energy of the actuator 7B is at least partly released so that the release feature 15 and the release feature guide 18 are pulled by the actuator 7B in the direction Y of the carriage 12, and so that the release feature 15 pushes the supply 3 into a mating position with the respective colorant interconnect 21. The released force of the actuator 7A, 7B is enough the establish a proper connection between the first and second interconnect 19, 21 (e.g. see FIGS. 5-8).

Figure 14:
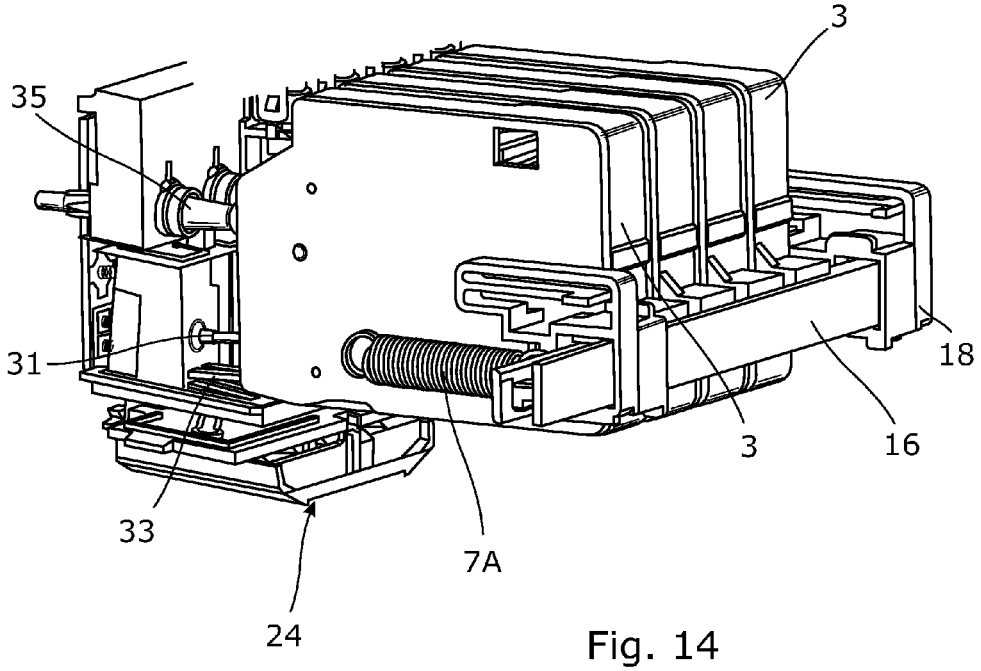
FIG. 14 illustrates another example of a portion of a colorant transfer system in perspective view.

FIG. 14 illustrates an example of an assembly of supplies 3 of multiple colors, wherein the supplies 3 are disconnected from the second colorant interconnects 31, 35. In the illustrated example, the second colorant interconnects 31, 35 include a bottom fluidic interconnect needle 31 and a top fluidic interconnect needle 35 for mating with corresponding fluidic interconnects of each of the supplies 3. In the illustrated example, the actuator 7A is in a first state, wherein the release feature 15 and release feature guide 18 are in a retained position.

In FIG. 14, a supply guide track 33 is partly shown. The guide track 33 engages the colorant supply 3, for moving the colorant supply 3 along the guide track 33 until the colorant interconnects 19, 21 (e.g. FIGS. 6, 8) are mated. In the release position, the actuator 7A forces the supplies 3 over the guide track 33 until mated. In some examples, the guide track 33 is arranged to fit a corresponding slot of the supply 3 to allow substantially multi-directional sliding. In some examples, the length of the guide track 33 is more than the distance between the fluidic interconnects 19, 21 in the first state. In the illustrated example, the guide track 33 has a T-shaped cross section perpendicular to the direction Y of guidance.

Figure 15:
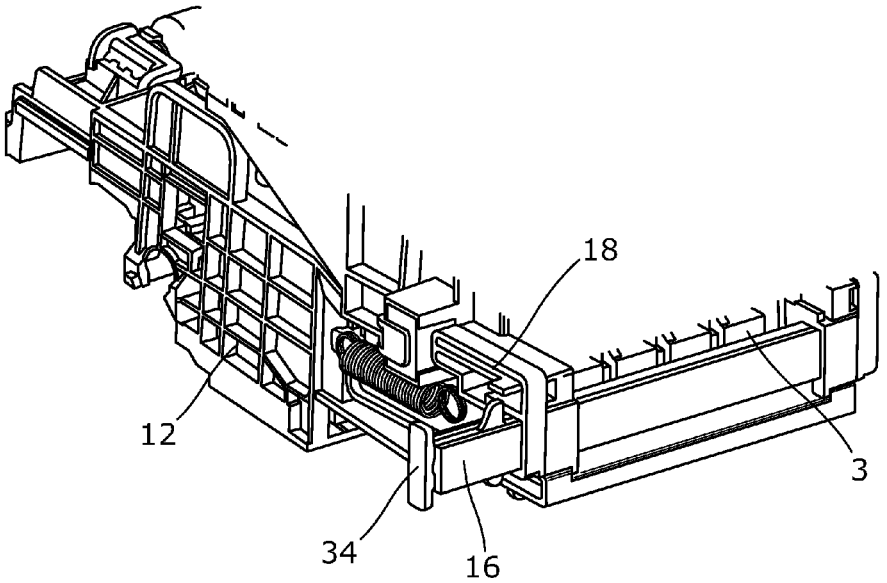
FIG. 15 illustrates a portion of another example of a portion of a colorant transfer system in perspective view.

FIG. 15 shows the release feature 15 and the release feature guide 18 in a first, retained state. In the illustrated example, a safety feature 34 is provided that is arranged to impede a movement of the release feature 15 into a release position, so that an establishing of the passage 40 is impeded. In some examples, the safety feature 34 is arranged to be connected near an end of the release feature 15. In some examples, the safety feature 34 is arranged to readily fit or be mounted onto the release feature 15 so that a disengagement of the release feature 15 with respect to the retainer 17 is prevented. For example, the safety feature 34 may be placed before a transport, and taken out before usage.

Figure 16:
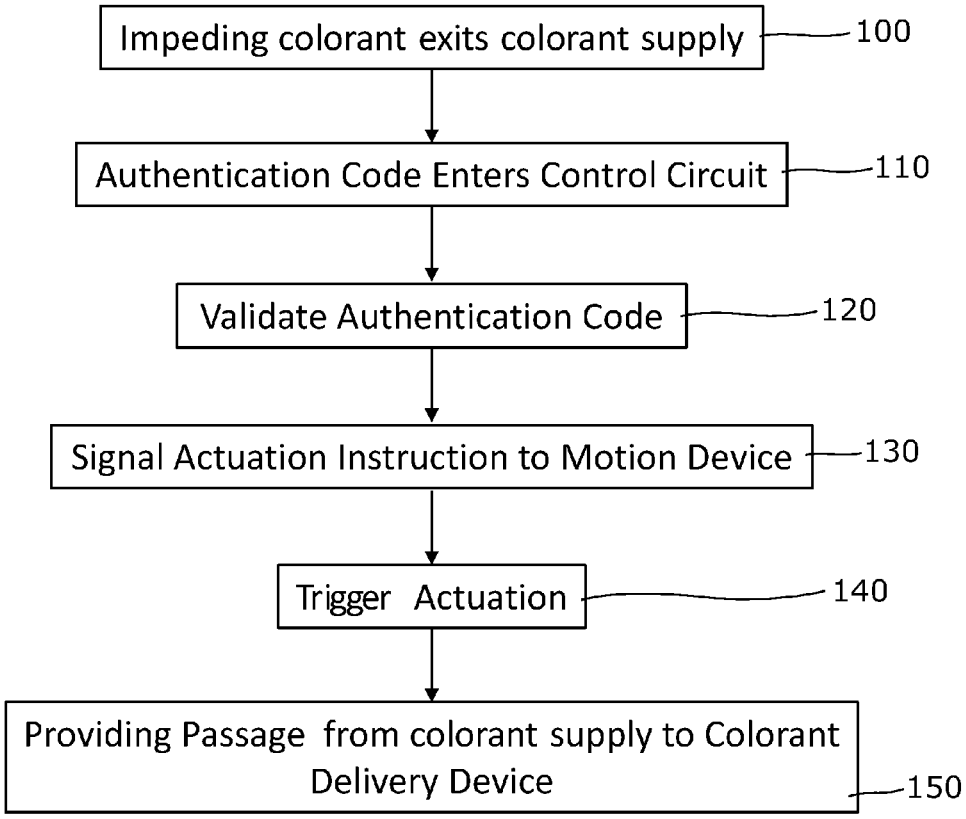
FIG. 16 illustrates a flow chart of an example of a method of activating a colorant transfer system.

FIG. 16 is a flow chart of an example of a method of activating a colorant transfer system 1. For example, the method includes impeding the colorant 2 from exiting the colorant supply 3 (block 100). For example, the method includes entering an authentication code 8 into the control circuit 5 (block 110). For example, the method includes, with the control circuit 5, validating the authentication code 8 (block 120). For example, the method includes, with the control circuit 5, signaling an actuation instruction to the motion device 6 (block 130). For example, the method includes the motion device 6 triggering a mechanical actuation (block 140), for example by triggering the actuator 7, 7A. For example, the method includes providing a passage 40 from the colorant supply 3 to the colorant delivery device 4 through said actuation (block 150).

Figure 17:
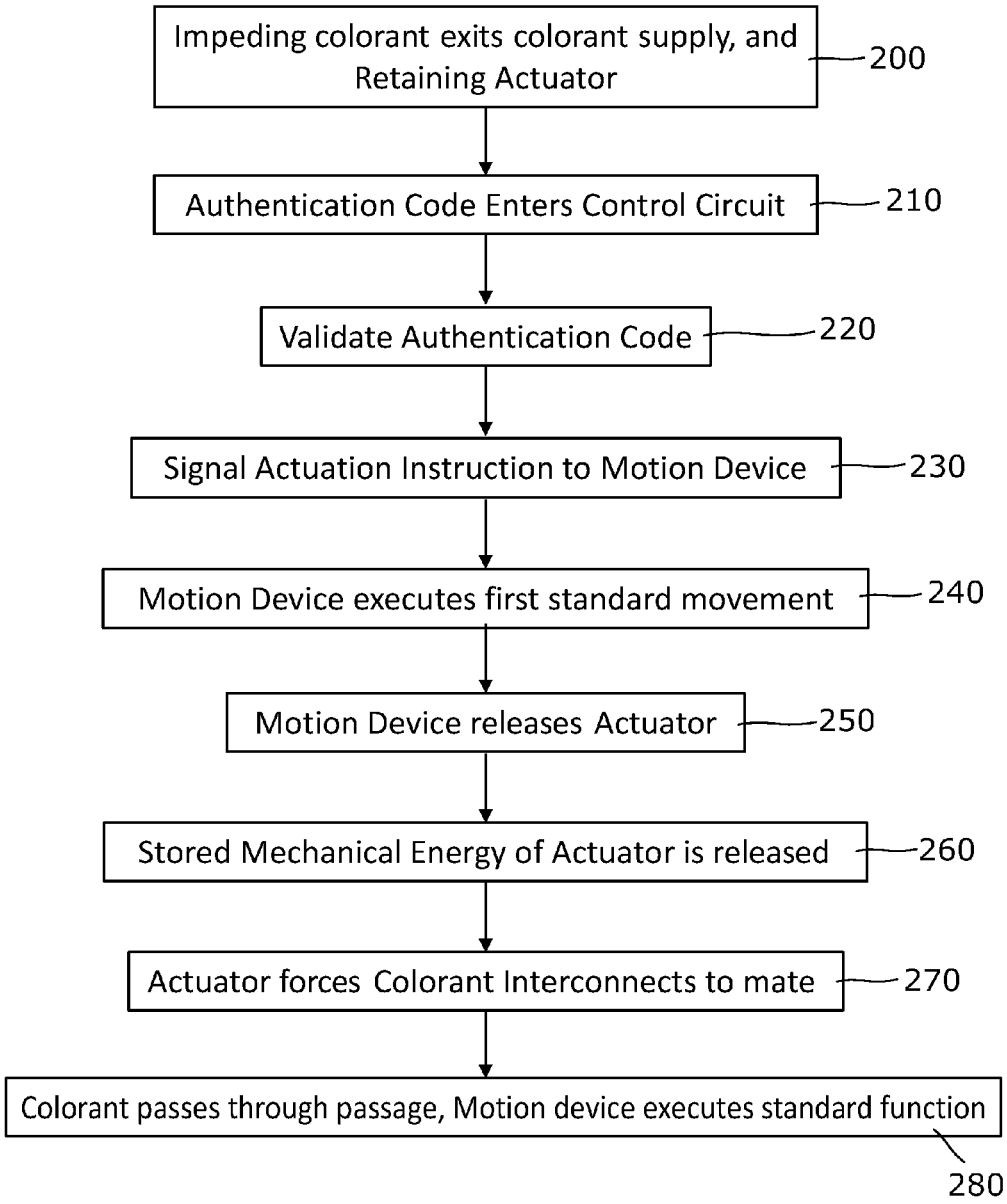
FIG. 17 illustrates a flow chart of another example of a method of activating a colorant transfer system.

FIG. 17 is a flow chart of another example of a method of activating a colorant transfer system 1. For example the colorant 2 includes liquid or dry toner or liquid ink. For example, the method includes impeding the colorant 2 from exiting the colorant supply 3 by retaining an actuator 7, 7A (block 200). For example, the method includes entering an authentication code 8 into the control circuit 5 (block 210). For example, the method includes, with the control circuit 5, validating the authentication code 8 (block 220). For example, the method includes, with the control circuit 5, signaling an actuation instruction to the motion device 6 (block 230). In some examples, the motion device 6 includes a media advance system, a printhead or carriage scanning system, a toner transfer roller, a photo conductor roller, an electromotor, a colorant delivery device scanning drive, or another drive or transmission component provided in the colorant transfer system 1 for executing standard print actions. In some examples, the motion device 6 may be mechanically linked to the actuator 7, 7A, 7B in multiple manners.

For example, the method includes executing a first standard movement 6C of the motion device 6 (block 240). Such first motion device movement 6C may be the first movement 6C of the respective motion device 6 after having validated the authentication code 8. In other such examples, the standard movement 6C includes a photoconductor roller movement, a transfer roller movement, a media advance roller movement, a printhead scanning movement, or other standard movements of a motion device component.

For example, the method includes releasing the actuator 7, 7A by said first standard movement 6C of the motion device 6 (block 250). For example, the method includes releasing a mechanical energy stored in the actuator 7, 7A (block 250). In some examples the first standard movement 6C forces a release feature 15 to displace with respect to a retainer 17, which causes the energy stored in the actuator 7, 7A to be released. In some examples, the release feature 15 is forced by a block 14 into a release position by a carriage scanning movement 60C, for example a first carriage scanning movement.

For example, the released energy of the actuator 7, 7A forces a first colorant interconnect 19 with respect to a second fluidic interconnect 21 so that both mate (block 270). With this action a passage 40 between the supply 3 and the colorant delivery device 4 is established and the colorant transfer system 1 is ready for use. In other examples, a passage 40 is established by a breaking unwrapping, opening, etc. of a seal 20 or valve or the like by the actuator's action.

After establishing the passage 40, the colorant 2 passes through the passage 40, and, in some examples, the motion device 6 executes one or more standard movements, for example corresponding to conventional printing movements, without further triggering the actuator 7, 7B (block 280). The standard print movements that are executed may include advancing media, rotating photoconductor or transfer rollers, rotating or translating components of the supply 3 or colorant delivery device 4, scanning a printhead 12, etc. The motion device 6 may execute the standard movements 6C during the rest of the lifetime of the colorant transfer system 1.

In some examples, the actuator 7, 7B is reset to the first state one or multiple times within the lifetime of the colorant transfer system 1. For example, a first authentication code 8 corresponding to a first payment releases a corresponding first amount of colorant 2 contained in the supply 3. When the first amount has been ejected than the system 1 resets itself to the first state and a second payment is needed to be made to release further colorant 2. In some examples, an internal colorant supply 3 is refilled and/or the whole system 1 may be recycled.

In some examples, mechanical inversion applies. For example the retainer 17 and the release feature 15 may be connected to different components, wherein one component is static and the other component is moving during actuation. Likewise, the block 14 and release feature 15 may also be connected to different components. Likewise, a needle and an insert, and inlet and outlet may be interchanged so that one is moving and the other is static.

In some examples, the disclosed system 1 and method involves automatic supply 3 installation, wherein the supply 3 comprises a cartridge, and the motion device 6 and/or the actuator 7, 7A, 7B cooperate to automatically install the respective cartridge.

One effect of some of the features discussed in this disclosures is that colorant 2 may be automatically released before a first usage, without the user needing to manually or mechanically install a colorant supply 3. Some of the example features disclosed may allow for a releasing of a colorant 2 amount only after a payment.

Another example described in this disclosure does not need extra components for providing the force needed to establish the connection between the supply 3 and the colorant delivery device 4. In fact, the force for establishing the passage 40 may be triggered by standard printer motion device components.

The above description is not intended to be exhaustive or to limit this disclosure to the examples disclosed. Other variations to the disclosed examples can be understood and effected by those of ordinary skillin the art from a study of the drawings, the disclosure, and the claims. The indefinite article "a" or "an" does not exclude a plurality, while a reference to a certain number of elements does not exclude the possibility of having more or less elements. A single unit may fulfil the functions of several items recited in the disclosure, and vice versa several items may fulfil the function of one unit. Multiple alternatives, equivalents, variations and combinations may be made without departing from the scope of this disclosure.

The invention claimed is:

1. A colorant transfer system, comprising:

a colorant supply to supply colorant contained in the supply to a colorant delivery device, the colorant supply having a first state wherein the colorant is impeded from exiting the colorant supply;

an actuator to provide a passage from the colorant supply to the colorant delivery device;

a control circuit to: validate an authentication code and, if the authentication code is validated, instruct the e actuator to provide the passage from the colorant supply to the colorant delivery device; and a colorant delivery device having a first colorant interconnect, and a second colorant interconnect to provide the colorant in the colorant supply to the colorant delivery device by mating with the first colorant interconnect, wherein in the first state, the first and second colorant interconnects are disconnected, and the actuator is arranged to move at least one of the colorant interconnects to mate with the other colorant interconnect to provide the passage.

2. The colorant transfer system of claim 1 further comprising a first motion device to mechanically trigger the actuator with a first movement, while a subsequent equal movement of the first motion device does not trigger the actuator.

3. The colorant transfer system of claim 1 wherein the actuator is to store a mechanical energy and, upon being triggered by the motion device, to release the mechanical energy and exert a force to provide the passage.

4. The colorant transfer system of claim 1 further comprising:

a retainer to retain the actuator against a stored force; and a release to release the actuator with respect to the retainer.

5. The colorant transfer system of claim 4 further comprising:

a carriage to be driven by a motion device; and a block to engage the release in response to scanning of the carriage in a first scanning action to thereby cause the release to move with respect to the retainer to thereby release the actuator.

6. The colorant transfer system of claim 1 further comprising a seal to inhibit leaking of colorant out of, or a fluid out of or into, the colorant supply, the seal being openable to provide the passage.

7. The colorant transfer system of claim 1 wherein the colorant supply comprises a pressure regulator and a colorant reservoir, the pressure regulator to regulate the supply of colorant from the colorant reservoir to the colorant delivery device, the colorant reservoir containing at least 50 milliliters of colorant to be ejected.

8. The colorant transfer system of claim 1 further comprising a data source connection circuit in circuit with the control circuit, the data source connection circuit to receive the authentication code from an external source.

9. A printer comprising the colorant transfer system of claim 1, wherein the actuator is to store mechanical energy and is to act upon the colorant supply, and the colorant delivery device comprises a printhead, the colorant transfer system further comprising:

the first colorant interconnect in communication with the printhead;

the second colorant interconnect in communication with the colorant supply;

a guide track to engage the colorant supply, the colorant supply movable along the guide track until the colorant interconnects are mated;

a retainer to retain the colorant supply against the force of the actuator in the first state; and a release to move into a release position with respect to the retainer to release the actuator to force the colorant supply along the guide track until the colorant interconnects are mated.

10. A method of activating a colorant transfer system, the colorant transfer system comprising a control circuit, a motion device and a colorant supply, the method comprising:

impeding colorant from exiting the colorant supply;

entering an authentication code into the control circuit;

validating the authentication code with the control circuit;

with the control circuit, signaling an actuation instruction to the motion device;

triggering a mechanical actuation with the motion device; and via the actuation, providing a passage from the colorant supply to a colorant delivery device, wherein triggering the mechanical actuation releases mechanical energy stored in an actuator via a first motion device movement, wherein releasing the mechanical energy forces a first colorant interconnect with respect to a second fluidic interconnect into a mated state; and further comprising:

passing colorant from the colorant supply to the colorant delivery device through the mated interconnects.

11. The method of claim 10, wherein releasing the mechanical energy further comprises:

scanning a carriage; and forcing a release feature into a release position through the scanning movement.

12. A colorant transfer system, comprising:

a colorant delivery device to supply colorant to media;

a colorant supply to supply colorant to the colorant delivery device;

a motion device; and a control circuit to validate an authentication code, and upon validating the authentication code, signal the motion device to automatically establish passage from the colorant supply to the colorant delivery device, wherein the colorant delivery device includes:

a first colorant interconnect; and a second colorant interconnect to provide the colorant in the colorant supply to the colorant delivery device by mating with the first colorant interconnect, wherein, in a first state, the first and second colorant interconnects are disconnected, and an actuator is arranged to move at least one of the colorant interconnects to mate with the other colorant interconnect to provide the passage.

* * * * *

UNITED STATES PATENT AND TRADEMARK OFFICE

CERTIFICATE OF CORRECTION

PATENT NO. : 9,096,070 B2
APPLICATION NO. : 14/368544
DATED : August 4, 2015
INVENTOR(S) : Anthony D. Studer et al.

It is certified that error appears in the above-identified patent and that said Letters Patent is hereby corrected as shown below:

In the claims

In column 11, line 26, in Claim 1, delete “the e” and insert -- the --, therefor.

Signed and Sealed this
Eighth Day of March, 2016

Michelle K. Lee

Michelle K. Lee
*Director of the United States Patent and Trademark Office*